US006632059B2

(12) United States Patent
Debrunner et al.

(10) Patent No.: US 6,632,059 B2
(45) Date of Patent: Oct. 14, 2003

(54) METHOD FOR ADHESIVE ATTACHMENT OF A COVER PROVIDED WITH A BINDING STRIP AND DEVICE FOR PERFORMING THE METHOD

(75) Inventors: Jakob Debrunner, Frauenfeld (CH); Mike Fritschi, Herdern (CH); Kaspar Furrer, Gachnang (CH)

(73) Assignee: GRAPHA-Holding AG, Hergiswil (CH)

( * ) Notice: Subject to any disclaimer, the term of this patent is extended or adjusted under 35 U.S.C. 154(b) by 0 days.

(21) Appl. No.: 09/924,938

(22) Filed: Aug. 8, 2001

(65) Prior Publication Data

US 2002/0021951 A1 Feb. 21, 2002

(30) Foreign Application Priority Data

Aug. 11, 2000 (EP) ..... 00810717

(51) Int. Cl.[7] ..... B42C 9/00

(52) U.S. Cl. ..... 412/8; 156/477.1; 156/578; 270/52.08; 270/58.08; 412/1; 412/5; 412/9; 412/17; 412/19; 412/22; 412/37

(58) Field of Search ..... 412/5, 1, 3, 4, 412/8, 9, 17, 13, 19, 20, 22, 37, 902, 16, 18, 21, 900; 270/52.07, 52.08, 58.07, 58.08; 156/477.1, 578, 908; 402/15

(56) References Cited

U.S. PATENT DOCUMENTS 3,802,723 A * 4/1974 Watson ..... 281/27
3,847,718 A * 11/1974 Watson ..... 281/21.1
4,244,069 A * 1/1981 Hale ..... 156/84
4,496,617 A * 1/1985 Parker ..... 156/908
4,898,506 A * 2/1990 Lazar ..... 412/17
5,052,873 A * 10/1991 Parker et al. ..... 412/13
5,193,962 A * 3/1993 Parker et al. ..... 412/8
5,261,769 A * 11/1993 Leclerc ..... 412/4
5,413,447 A * 5/1995 Rathert ..... 198/689.1
5,779,423 A * 7/1998 Bermingham ..... 281/21.1
6,155,763 A * 12/2000 Parker et al. ..... 412/19
6,322,867 B1 * 11/2001 Rush et al. ..... 281/21.1
2002/0021951 A1 * 2/2002 Debrunner et al. ..... 412/4

FOREIGN PATENT DOCUMENTS

DE 3742424 6/1989
EP 0404556 12/1990

OTHER PUBLICATIONS

"Technologie Der Klebebindung" by Alfred Furler, paragraphs 8.5 and 8.6.
Brochure, Müller Martini, Corona—Perfect Binding Technology.

* cited by examiner

*Primary Examiner*—Monica Carter
(74) *Attorney, Agent, or Firm*—Friedrich Kueffner

(57) ABSTRACT

In a method for adhesive attachment of a cover and a binding strip on the flanks of a spine of an book block comprised of bound printed sheets, the book block is transported in a transport direction on a circulating transport device. A binding strip is placed onto the book block spine such that lateral strip parts project laterally past the spine. The cover is moved into a proper position relative to the book block spine in accordance with the cycle of the book block and in the transport direction of the book block. At least one of the lateral strip parts is loaded on a side facing away from the cover with a pressing element. The cover and the book block pass through a pressing device in order to connect the cover and the book block to one another.

14 Claims, 1 Drawing Sheet

METHOD FOR ADHESIVE ATTACHMENT OF A COVER PROVIDED WITH A BINDING STRIP AND DEVICE FOR PERFORMING THE METHOD

BACKGROUND OF THE INVENTION

1. Field of the Invention

The invention relates to a device for adhesive attachment of a cover, configured for receiving a binding strip, to the flanks of a spine of a book block which is formed of bound printed sheets and transported by means of a circulating transport device, wherein the cover to be combined with a binding strip is transferred, in accordance with the cycle of the transported book block and approximately in the same direction to the book block's transport direction, to the spine of the book block for positioning thereat and is connected with the book block during the subsequent pass through a pressing path with pressing device.

2. Description of the Related Art

It is known to provide, for the purpose of reinforcing, the spine of a book with strips of paper, textile materials or the like, a so-called binding strip, wherein the binding strips are separated from a web, which extends transversely or longitudinally to the path of back gluing processing, and are then combined with a cover being fed to the book block. Parallel glue strips are applied onto the cover during the course of feeding at a greater spacing to one another than the thickness of the book block in order to connect by means of a conveying roll, arranged downstream of the cover feeding device, the cover to the binding strip and the binding strip to the book block, i.e., to its spine provided with a glue layer, while the book block and the cover are being moved in the same direction.

It would be possible also to provide the underside of the binding strip with two spaced-apart glue strips.

The further transport of the cover connected with the binding strip is carried out by the transport device of the back gluing machine for transporting the book block where subsequently a pressing of the cover and of the binding strip onto both flanks, provided with glue, of the book block spine is carried out. For this purpose, the book block spine, which has been provided at the adjoining flanks with strips of glue, passes through a pressing station in which the cover and the laterally projecting parts of the binding strip are engaged by a parallel-moving pressing device and are pressed against the book block (disclosed in "Technologie der Klebebindung" by Alfred Furler, particularly in paragraphs 8.5 and 8.6, but also well-known from the back gluing machine of the Muller Martini Bookbinding Systems).

From the time of feeding the cover up to the point of pressing the cover and the binding strip onto the book block, there is no certainty that the cover can be reliably connected via the glue strips to the binding strip, in particular, because the parts of the binding strip projecting laterally past the spine of the book block and the oppositely positioned cover have no planar surface and no means have been provided so far to secure them in their relative position to one another. This results in the condition that the cover and the binding strip on the transfer path into the pressing station with the pressing device can be moved relative to the book block.

SUMMARY OF THE INVENTION

It is an object of the present invention to provide a method and a device for the adhesive attachment of a cover provided with a binding strip onto an book block by which method and device the reliability of a precise connection of the cover with the book block is ensured.

In accordance with the present invention, this is achieved in that at least one of the lateral parts of the binding strip projecting laterally past the book block spine are loaded on the side facing away from the cover by a pressing element.

In this connection, a mechanical device, for example, a holding-down device, can provide a beneficial and simple pressing means.

One embodiment of a device for performing the method according to the invention comprises a cover conveying device and a binding strip conveying device positioned alongside a transport device for the book block and having arranged downstream thereof a pressing device acting on the cover, wherein the device is characterized in that the cover conveying device and the binding strip conveying device have correlated therewith a pressing element in the form of a compressed air supply device or an adjustable holding-down device acting on the lateral parts of the binding strip projecting laterally past the book block.

Preferably, the pressing element acting on the lateral projecting parts of the binding strip can be realized by compressed air.

Expediently, the compressed air can be supplied in a controlled fashion, i.e., can be switched on and off and/or can be adjusted with respect to amount and speed, i.e., can be adjusted to the respective conditions.

For reinforcing the adhesion between the cover, the binding strip, and the book block spine, the cover can be provided on the transfer path into the pressing station with two parallel strip-shaped glue applications having a larger spacing than the thickness of the book block.

Advantageously, the compressed air supply device directed onto the binding strip parts is arranged oppositely to at least one conveying roll supporting the cover so that a counterpressure is built up which forces the respective parts against one another.

Expediently, the compressed air supply device is connected with a compressed air source and can be controlled or adjusted with respect to the supplied amount of air and/or the speed of the compressed air.

Advantageously, the compressed air supply device is arranged so as to be adjustable in accordance to the thickness of the book block to be processed and is thus adaptable correspondingly.

The method according to the invention can be used preferably in connection with a back gluing machine or the like for the manufacture of books.

DESCRIPTION OF THE PREFERRED EMBODIMENTS

Figure 1:
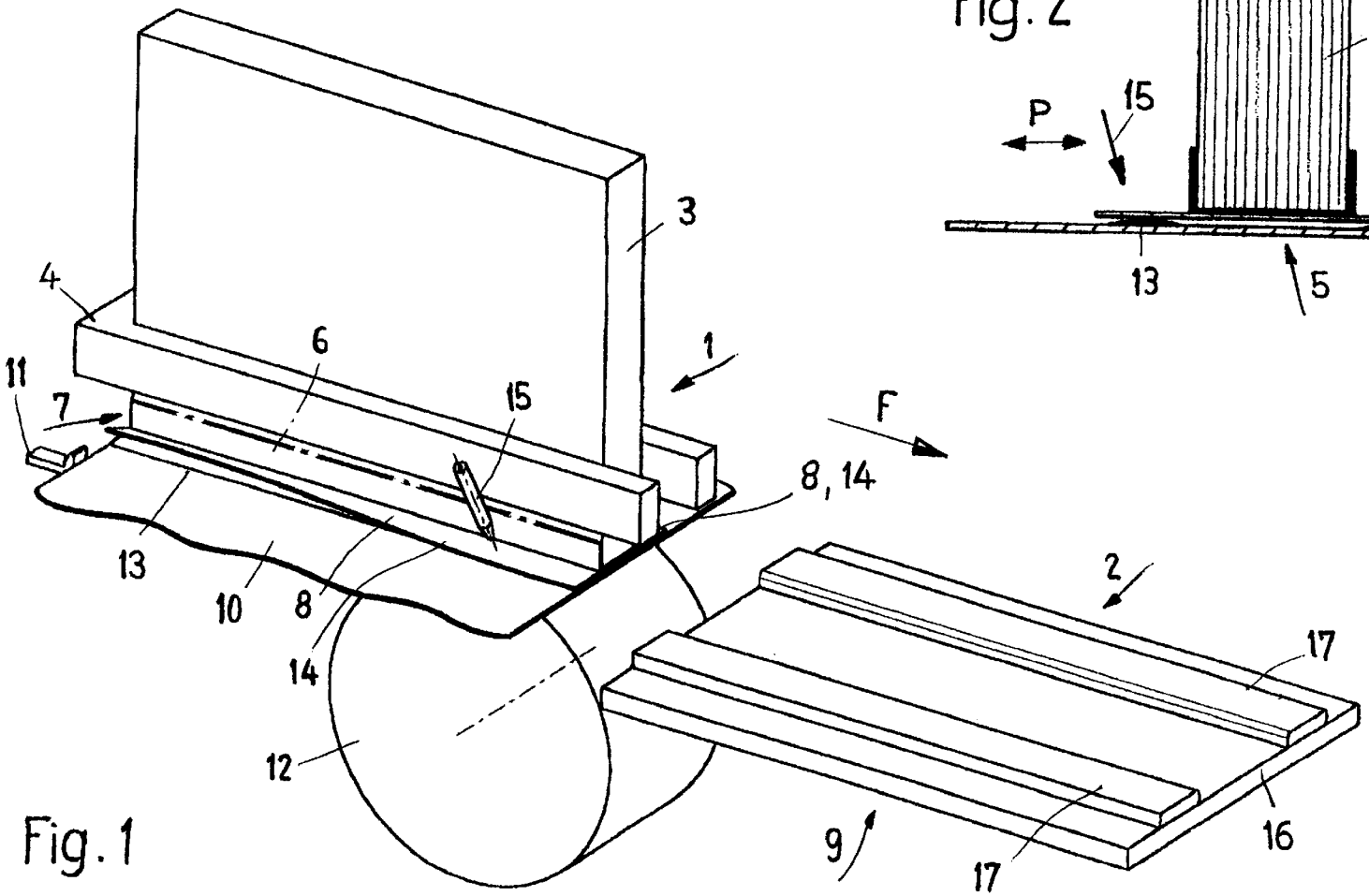
FIG. 1 is a perspective illustration of the device according to the invention in connection with a back gluing machine.

FIG. 1 illustrates partially the transport device 1 of a back gluing machine in the area of the cover conveying device and a binding strip conveying device and a pressing path 2 with a pressing device 9 arranged downstream thereof. The book block 3, which has been previously processed and subsequently provided with a glue application in the back gluing machine, is clamped in a schematically illustrated clamping device 4 of the transport device 1 so that only the glued book block spine 5 and the flanks 7, adjoining the spine 5 and already provided with a glue application 6 as indicated by the dashed dotted line, project in the downward direction. The arrow F is the transport direction of the transport device 1 which is comprised of a plurality of successively arranged clamping devices 4. The binding strip 8 is already correctly aligned relative to the spine 5 of the book block and will be subsequently pressed, while in this aligned position, by the pressing device 9, together with the cover 10, onto the spine 5 of the book block 3 and onto the flanks 7. The binding strip 8 can be supplied as a section of a web removed from a roll in a direction transverse to the transport direction F of the transport device 1, as is known and described, for example, in connection with the back gluing machines of the company Muller Martini Buchbinde-Systeme AG, or in the same direction supplied in the form of a narrow strip, as is disclosed inter alia in "Technologie der Klebebindung". Also, the supply of the cover 10 is described in an exemplary fashion in this reference and is illustrated in FIG. 1 schematically by the driver 11 of the conveying device. The driver 11 drops down before reaching a conveying roll 12 that is positioned underneath the transport plane of the spine 5 and provided for pressing while being active also as a conveying means, the binding strip 8 and the cover 10 together against the book block spine 5.

The cover 10, which preferably has been provided on its conveying path with two parallel strip-shaped glue applications 13, is connected by a pressing force exerted by the conveying roll 12 via the binding strip 8 with the book block 3, i.e., its spine 5 on the conveying device 1 and is moved farther into the pressing path 2. For obtaining an optimal connection between the cover 10 and the book block 3 in the transport device 1, a displacement-free adhesion of the cover 10 with the binding strip 8 by means of the strip-shaped applications 13 is an absolute requirement.

Figure 2:
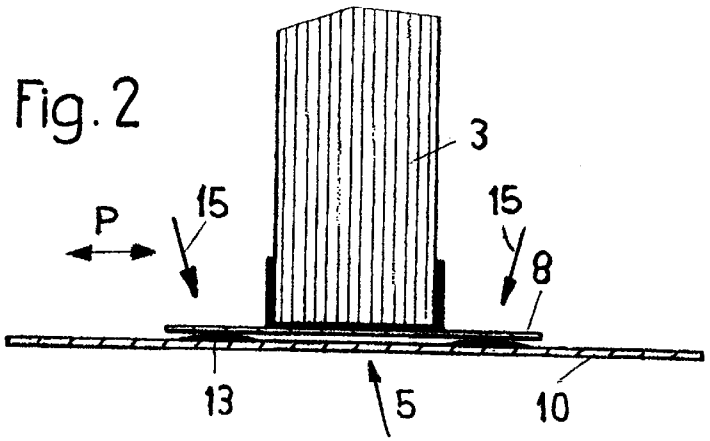
FIG. 2 is a schematic illustration in a view transverse to the transport direction of the parts of a book to be connected by gluing.

In order for an immobile alignment between the cover 10 and the binding strip 8 to be possible, the binding strip 8, which is positioned as a non-planar element, is loaded on its lateral parts 14 projecting laterally past the book block 3 by an air current which is generated by the nozzles 15 oriented onto the lateral parts 14 of the binding strip 8. The nozzles 15 are positioned above the conveying roll 12 on which the cover 10 is supported so that the air current blows the lateral parts 14 onto the cover 10 provided with the glue strips 13. At least one of the nozzles 15 is preferably stationarily arranged on each side of the book block 3, respectively. This situation is illustrated in FIGS. 1 and 2. In view of the changing processing situations as a result of the different material properties, the air current supplied in the form of compressed air can be changed by a simple control, i.e., can be adjusted to the momentary processing conditions. In this connection, the nozzles 15 are connected to a source of compressed air, and the connecting lines are provided with controllable valves.

For the adjustment to books block 3 of different thickness, the nozzles 15 are adjustable and movable transverse to the transport direction F (see double arrow P of FIG. 2).

Instead of the nozzles 15 as a pressing element, it is also possible to employ mechanical holding-down elements (not illustrated) acting onto the lateral parts 14 of the binding strip 8 with which the lateral parts 14 are pressed against the cover 10, wherein the holding-down elements can act in an elastically yielding way, for example, supported by means of a spring, on the lateral parts 14 of the binding strip 8.

After placement or positioning of the binding strip 8 and the cover 10 on the book block spine 5, the pressing of both parts onto the book block 3, respectively, onto the adhesive-coated flanks 7 adjoining the spine 5 is carried out by the pressing device 9 arranged downstream, wherein the pressing device 9 is driven during pressing in the same direction and with the same speed as the transport device 1. When doing so, the pressing device 9, comprised of a plate 16 acting on the spine 5 and two strips 17 moveable perpendicularly to the transport direction F and acting onto the flanks 7 of the book block spine 5, is moved in a circulating movement (as is known in the art) upwardly and then in the transport direction F and is subsequently lowered again with the strips 17 being open.

While specific embodiments of the invention have been shown and described in detail to illustrate the inventive principles, it will be understood that the invention may be embodied otherwise without departing from such principles.

What is claimed is:

1. A method for adhesive attachment of a cover and a binding strip together on the flanks of a spine of a book block comprised of bound printed sheets, the method comprising the steps of:

a) transporting the book block in a transport direction on a circulating transport device;

b) placing the cover relative to the spine of the book block such that lateral back lining strip parts project laterally past the spine;

c) moving the cover into a proper position relative to the spine of the book block in accordance with a cycle of the book block and in the transport direction of the book block;

d) loading at least one of the lateral back lining strip parts on a side thereof facing away from the cover with a pressing element;

e) passing the cover and the book block through a pressing device and connecting the cover and the book block to one another.

2. The method according to claim 1, wherein the pressing element is a compressed air supply device.

3. The method according to claim 2, wherein the compressed air supply device is configured to provide a controlled supply of compressed air.

4. The method according to claim 1, wherein the pressing element is a holding-down device providing a non-positive or positive holding action.

5. The method according to claim 1, further comprising the step of applying glue onto a side of the cover facing the binding strip before carrying out the step c).

6. The method according to claim 1, comprising the step of gluing the printed sheets to form the book block in a back gluing machine before carrying out the step a).

7. A device for performing the method according to claim 1, the device comprising:

conveying devices configured to move the cover and the binding strip to the book block, wherein the conveying devices are arranged alongside a transport device for the book block;

a pressing element configured to act on at least one of two lateral strip parts projecting laterally past the spine of the book block on a side thereof facing away from the cover; and a pressing device configured to press the cover onto the book block and arranged downstream of the conveying device.

8. The device according to claim 7, wherein the pressing element is a compressed air device.

9. The device according to claim 8, comprising at least one conveying roll configured to support the cover, wherein the compressed air device is arranged opposite the at least one support roll relative to the cover.

10. The device according to claim 8, wherein the compressed air device is connected to a compressed air source.

11. The device according to claim 8, wherein the compressed air device is configured to adjust and control the speed and the amount of the compressed air acting on the at least one lateral part of the binding strip.

12. The device according to claim 8, wherein the compressed air device is configured to be adjustable relative to a thickness of the book block.

13. The device according to claim 7, wherein the pressing element is an adjustable holding-down device.

14. The device according to claim 13, comprising at least one conveying roll configured to support the cover, wherein the holding-down device is arranged opposite the at least one support roll relative to the cover.

* * * * *